United States Patent [19]

Porat

[11] Patent Number: 4,624,456

[45] Date of Patent: Nov. 25, 1986

[54] APPARATUS FOR ACTUATING A SUCTION WORKHOLDER

[75] Inventor: Thomas M. Porat, Weare, N.H.

[73] Assignee: Crathern Engineering Co., Inc., Contoocook, N.H.

[21] Appl. No.: 780,623

[22] Filed: Sep. 26, 1985

[51] Int. Cl.[4] ..... B65H 3/08

[52] U.S. Cl. ..... 271/103; 271/108

[58] Field of Search ..... 271/103, 90, 91, 99, 271/108

[56] References Cited

U.S. PATENT DOCUMENTS 3,091,995 6/1963 Allison ..... 271/103 X 4,505,469 3/1985 Kakimoto ..... 271/103 X

FOREIGN PATENT DOCUMENTS 623151 5/1949 United Kingdom ..... 271/103

*Primary Examiner*—Richard A. Schacher

*Attorney, Agent, or Firm*—Schiller & Pandiscio

[57] ABSTRACT

An improved apparatus for actuating a suction workholder having a hollow piston slidably mounted in a hollow cylinder. A suction cup is mounted on a distal end of the piston and is in pneumatic communication with a proximal end of said piston via the interior of the piston. A housing defining a vacuum plenum is so attached to the cylinder as to permit pneumatic communication between the plenum and the proximal end of said piston. The improvement resides in a unique positioning of ports and apertures which create pneumatic pressure differentials causing movement of the piston. The use of a biasing spring is not required.

6 Claims, 1 Drawing Figure

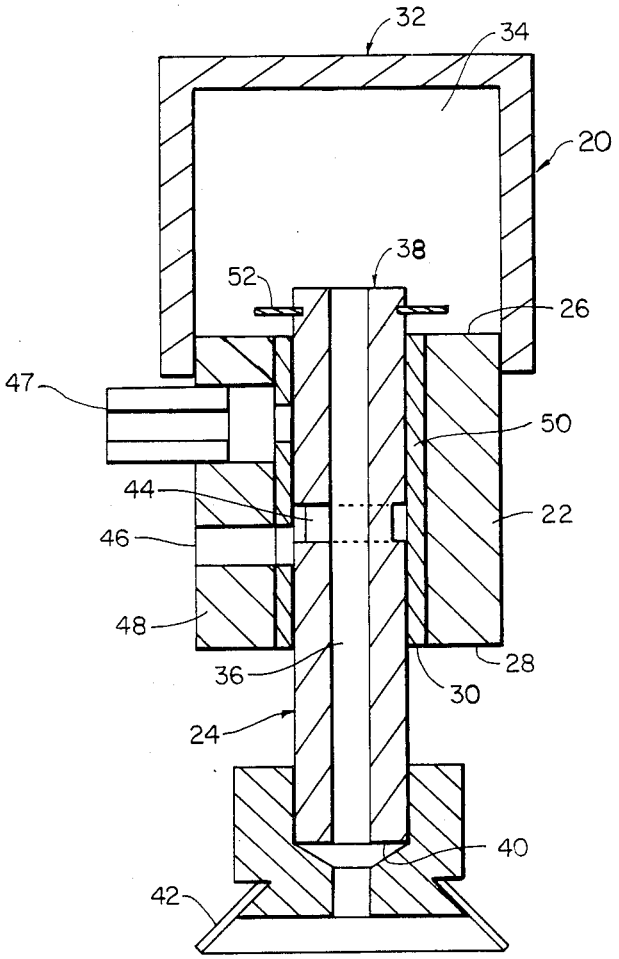
32
34
20
38
52
26
47
50
44
22
46
48
36
28
30
24
40
42

APPARATUS FOR ACTUATING A SUCTION WORKHOLDER

This invention relates to material handling devices, and more particularly, to suction workholders of the type used to move discrete sheets of material between work stations in the printing or other industries.

Suction workholders, well-known in the printing and other industries, are typically used to remove a sheet of material, such as paper or cardboard, from a stack and/or to hold the sheet during transport to a remote worksite. Many prior art workholders, such as those disclosed in U.S. Pat. Nos. 3,107,794, 3,834,558, 3,921,971, and 4,189,137, include a piston slidably mounted in a body, a suction cup being attached to the piston.

A major problem with known suction workholders can be the relatively slow rate at which the vacuum builds up in the cup. Another problem with a number of prior art suction workholders is that a spring is used for biasing the piston in a selected direction, adding to the mechanical complexity, unreliability and cost of the device.

Typically, a workpiece is released from a vacuum cup by terminating the vacuum supply to the workholder, or by forcing the workpiece off of the holder with a second suction workholder. In both of these methods of releasing the workpiece, the tension of the spring creates a resistance to movement of the piston in at least one direction. Overcoming this tension interposes a delay that tends to be undesirable in high-speed operations.

An additional problem with such prior art suction workholders arises where the vacuum is broken upon removing the sheet from the suction cup with a second workholder. Because such removal generally occurs suddenly, undesirable stresses may be thereby imposed on the workpiece and on the workholder.

A principal object of the invention is to provide a suction workholder having a minimum of mechanical parts. Another object is to provide a suction workholder in which the vacuum at the cup is established very quickly and which is capable of quickly and smoothly releasing the work at a selected time in the sequence of an industrial operation. An additional object is to provide a suction workholder wherein sudden removal of the workpiece does not impose undesirable stresses on the workpiece. Still another object is to provide a suction workholder capable of securely gripping a workpiece during movement of the workpiece between industrial operations.

These and other objects are achieved in a suction workholder comprising a hollow cylinder, a tubular piston slidably disposed in the interior of the cylinder, and a vacuum plenum chamber in pneumatic communication with one end of the interior of the cylinder. The tubular interior of the piston serves to pneumatically connect the vacuum plenum with a suction cup mounted on the distal end of the piston. An aperture is provided through the wall of the piston intermediate the ends thereof. A first port extending through the wall of the cylinder is provided for selectively (depending on a first axial position of the piston in the cylinder) registering the aperture with the first port in the cylinder wall, thereby pneumatically connecting the tubular interior of the piston with the atmosphere. A second port intended to be coupled to a vacuum source extends through the wall of the cylinder and is selectively registerable into the aperture at a second axial position of the piston in the cylinder. A keyway (not shown) may be provided in the piston and cylinder to insure radial alignment of the first port with the aperture.

In operation, when the workholder is lowered onto a workpiece, the piston is forced into the second axial position at which the vacuum source is coupled through the second port to the interior of the piston. This creates a negative pressure at the suction cup. Because the surface of a workpiece blocks entry of ambient atmospheric gases into the suction cup, the workpiece becomes firmly held by the cup. The piston serves as a valve to occlude pneumatic communication, through the first port in the cylinder wall, between the ambient atmosphere and the aperture in the piston. When the workpiece is forced downwardly to strip it from the vacuum cup, the piston is also moved downwardly in the cylinder, registering the first port and piston aperture to the outside. When this coupling is first achieved, only a small portion of the first port is aligned with the aperture. As the piston continues its downward travel, increasingly large portions of the port are aligned with the aperture. This gradually increasing alignment results in a gradual reduction over time of the suction force at the suction cup. As a result, the introduction of undesirable stresses and surges is avoided. As is clear from the preceding summary, the subject invention performs its intended functions without the use of a spring for biasing the piston in a selected direction.

Other objects of the invention will in part be obvious and will in part appear hereinafter. The invention accordingly comprises the apparatus possessing the construction, combination of elements, and arrangement of parts which are exemplified in the following detailed diclosure, and the scope of the application of which will be indicated in the claims.

For a fuller understanding of the nature and objects of the present invention, reference should be had to the following detailed description taken in connection with the accompanying drawing wherein there is shown a sectional view in front elevation of the suction workholder.

Referring to the drawing, suction workholder 20 is shown comprising hollow cylinder 22 and piston 24. The cylinder 22 is open at opposite ends 26 and 28. Hollow cylindrical bushing 30 is so disposed as to line the interior of cylinder 22.

Housing 32, defining vacuum plenum 34, is coupled to end 26 of cylinder 22. Housing 32 is configured to provide pneumatic communication between vacuum plenum 34 and the interior of cylinder 22.

Piston 24, in the form of an elongated hollow tube, is mounted for axial sliding movement in bushing 30. Conduit 36 is provided axially and centrally within piston 24 for pneumatically connecting end 38 of piston 24 with opposite end 40 of piston 24. Since end 38 of piston 24 is in direct pneumatic communication with vacuum plenum 34, conduit 36 serves to pneumatically connect end 40 of piston 24 with plenum 34. Aperture 44 extends through the wall of piston 24 intermediate ends 38 and 40, thereby providing pneumatic communication between conduit 36 and the outer surface of the piston 24.

Attached to end 40 of piston 24 is annular suction cup 42. Cup 42 is configured in known manner to contact a workpiece, such as a sheet of cardboard or paper and the like.

Atmospheric port 46 is provided extending entirely through wall 48 of cylinder 22 and wall 50 of the bushing 30 between the interior surface of cylinder 22 and the ambient outside atmosphere. Port 46 is so disposed with respect to aperture 44 that when piston 24 is in a first or substantially fully downwardly extended position, port 46 is aligned or registered with aperture 44, pneumatically connecting conduit 36 with the ambient atmosphere.

Vacuum port 47 is provided, also extending through walls 48 and 50 between the interior surface of cylinder 22 and a conduit connecting to a vacuum source (not shown), for example, through conventional pneumatic coupling means (not shown). Port 47 is so disposed with respect to aperture 44 that when piston 24 is in a second or substantially fully upwardly withdrawn position, port 47 is registered with aperture 44, pneumatically connecting conduit 36 with the vacuum source.

Snap ring 52 is attached to end 38 of piston 24. Ring 52 is positioned to arrest the downward travel of piston 24 in cylinder 22 at the point where port 46 is directly aligned with the aperture 44.

In the drawing, piston 24 is shown in a position where there is partial alignment between port 46 and aperture 44. Any position of piston 24 where such partial alignment, and hence partial pneumatic communication, exists between port 46 and the aperture 44 will be referred to as the first position, and similar considerations extend to the second position wherein the alignment of port 47 and aperture 44 occurs.

In operation, suction workholder 20 is normally positioned with suction cup 42 disposed downwardly so that gravity causes piston 24 to move toward the position shown in the drawing. Typically, workholder 20 and companion similar workholders are attached to a movable arm (not shown) for movement between various work sites in an industrial operation.

Initially, that movable arm positions annular suction cup 42 above a workpiece and is either moved down to contact the workpiece or the workpiece is moved upwardly to contact cup 42. Because at this point port 47 is covered by the piston, the pressures inside and outside the cup are substantially equalized. However, as the workpiece, in contact with the cup, force the piston upwardly, the piston arrives at the second position in which port 47 and aperture 44 are aligned. If a vacuum is present at port 47, conduit 36 and plenum 34 become evacuated, creating a negative pressure at cup 42. Because the latter is blocked by the workpiece, conduit 36 is sealed adjacent end 40, and a negative pressure will be maintained in plenum 34. This negative pressure holds piston 24 in the second position with a force equal to the product of the surface area of end 38 multiplied by the pressure differential between the vacuum in plenum 34 and the ambient air pressure outside the device.

It should be noted that for the vacuum valve (formed by port 47 and aperture 46) to be open, a workpiece must be on cup 42. The only volume which needs to be evacuated through the vacuum valve is conduit 36 and plenum 34, a small and limited volume. The vacuum line extending from port 47 to a vacuum source, such as a pump, then can serve as a vacuum reservoir instead of a reservoir of air which must be evacuated. This permits rapid pick-up by the workholder because little time is required to recover lost vacuum.

In normal operation, the workpiece is handled only from the side facing cup 42. Consequently, to remove the workpiece, a second vacuum cup (not shown), or other means, forces the workpiece downwardly. As piston 24 correspondingly moves downwardly, aperture 44 moves out of alignment with port 47, and the piston seals the latter, closing the vacuum valve. As the piston continues to move down, it arrives at the first position in which aperture 44 is aligned with and pneumatically communicates with port 46, thus opening the air valve effectively formed by aperture 44 and port 46.

The vacuum in conduit 36 is thus broken, releasing any vacuum forces tending to lift the piston and also releasing the workpiece from cup 42. Because at first only a small portion of the port is aligned with the aperture, the reduction of vacuum at the suction cup is slight. The continued reduction of vacuum at the suction cup occurs at a rate which is proportional to the increasing percentage of overlap between port and aperture. This continued, gradual reduction of vacuum permits the smooth removal of the workpiece from the cup 42 thereby avoiding creation of undesirable stresses and vibrations.

Since certain changes may be made in the above apparatus without departing from the scope of the invention herein involved, it is intended that all matter contained in the above description or shown in the accompanying drawing shall be interpreted in an illustrative and not in a limiting sense.

What is claimed is:

1. An apparatus for pneumatically holding and permitting removal of a workpiece, said apparatus comprising:

a cylinder having a hollow interior between opposite ends of said cylinder;

means for defining a vacuum plenum at one of said ends of said cylinder, said plenum being in pneumatic communication with the interior of said cylinder;

a first port opening through the wall of said cylinder in pneumatic communication with said interior of said cylinder for connecting said interior to ambient pressure;

a second port opening through the wall of said cylinder in pneumatic communication with the interior of said cylinder for pneumatically connecting said interior with a vacuum source; and holder means for holding said workpiece with a vacuum, said holder means including a piston, said piston including means for defining a conduit through said piston and an aperture disposed through said piston in pneumatic communication with said conduit, said piston being slidably mounted in the interior of said cylinder for movement between at least a first position wherein said first port is pneumatically closed and said second port, piston aperture, conduit and vacuum plenum are all in penumatic communication so that a vacuum can be applied to said workpiece so as to hold said workpiece, and a second position wherein said second port is pneumatically closed and said first port, piston aperture, conduit and vacuum plenum are all in pneumatic communication so that ambient pressure can be applied to said workpiece so as to permit removal of said workpiece.

2. An apparatua according to claim 1, further comprising a stop attached to a proximal end of said Piston so as to retain a selected portion of said piston in said cylinder.

3. An apparatus according to claim 1, wherein said holder means further comprises a suction cup shaped for contacting said workpiece, said cup being attached to a distal end of said piston so as to be in Pneumatic communication with said conduit.

4. An apparatus according to claim 1, further comprising a sleeve mounted in the interior of said cylinder, the interior of said sleeve being sized for receiving said piston, said sleeve having an opening disposed so as to provide pneumatic communication between said aperture of said piston and said first port only when said piston is in said second position and between said aperture of said piston and said second port only when said piston is in said first position.

5. An apparatus according to claim 1, wherein said piston is substantially fully extended from the interior of said cylinder when in said second position and substantially fully withdrawn into the interior of said cylinder when in said first position.

6. An apparatus according to claim 1, wherein said piston aperture is positioned in said piston so as to connect said first port to said conduit when said piston is in said second position, and connect said second port to said conduit when said piston is in said first position.

* * * * *

UNITED STATES PATENT AND TRADEMARK OFFICE

CERTIFICATE OF CORRECTION

PATENT NO. : 4624456

DATED : November 25, 1986

INVENTOR(S) : Thomas M. Porat

It is certified that error appears in the above-identified patent and that said Letters Patent is hereby corrected as shown below:

Claim 1, column 4, line 54, delete "penumatic" and substitute therefor --"pneumatic"--;

Claim 2, column 4, line 62, delete "apparatua" and substitute therefor --"apparatus"--;

Claim 2, column 4, line 63, delete "Piston" and substitute therefor --"piston"--; and Claim 3, column 5, line 1, delete "Pneumatic" and substitute therefor --"pneumatic"--.

Signed and Sealed this

Twenty-first Day of April, 1987

*Attest:*

DONALD J. QUIGG

*Attesting Officer*

*Commissioner of Patents and Trademarks*